US006705330B1

(12) United States Patent
Favret

(10) Patent No.: US 6,705,330 B1
(45) Date of Patent: Mar. 16, 2004

(54) DISHWASHING MACHINE WITH LIQUOR DISTRIBUTION VALVE

(75) Inventor: Ugo Favret, Casarsa (IT)

(73) Assignee: Electrolux Zanussi S.p.A., Pordenone (IT)

( * ) Notice: Subject to any disclaimer, the term of this patent is extended or adjusted under 35 U.S.C. 154(b) by 0 days.

(21) Appl. No.: 10/019,821

(22) PCT Filed: May 23, 2000

(86) PCT No.: PCT/EP00/04692

§ 371 (c)(1),
(2), (4) Date: Feb. 26, 2002

(87) PCT Pub. No.: WO01/03568

PCT Pub. Date: Jan. 18, 2001

(30) Foreign Application Priority Data

Jul. 13, 1999 (IT) ..... PN99A0058

(51) Int. Cl.[7] ..... B03B 3/02

(52) U.S. Cl. ..... 134/56 D; 134/95.3; 134/99.1; 134/174

(58) Field of Search ..... 134/56 R, 56 D, 134/94.1, 95.3, 96.1, 99.1, 103.2, 172, 173, 174, 178, 198

(56) References Cited

U.S. PATENT DOCUMENTS

| | | | | |
|---|---|---|---|---|
| 199,267 | A | * | 3/1935 | Ferguson |
| 2,181,792 | A | * | 11/1939 | Rupp et al. |
| 2,440,161 | A | * | 4/1948 | Vaudreuil |
| 3,144,832 | A | * | 8/1964 | Haynes |
| 4,252,140 | A | * | 2/1981 | Hildebrandt |
| 4,741,353 | A | * | 5/1988 | Miloccco |
| 4,746,278 | A | * | 5/1988 | Henderson |
| 5,264,043 | A | * | 11/1993 | Milocco |
| 5,494,062 | A | * | 2/1996 | Springer |
| 5,601,111 | A | * | 2/1997 | Sodergard |
| 5,849,101 | A | * | 12/1998 | Edwards et al. |
| 5,899,433 | A | | 5/1999 | Kim et al. |

FOREIGN PATENT DOCUMENTS

| | | | |
|---|---|---|---|
| EP | 237 994 | A | 9/1987 |
| EP | 727 180 | A | 8/1996 |
| JP | 5899566 | * | 6/1983 |
| JP | 63-6276 | * | 1/1988 |
| JP | 9-287670 | * | 11/1997 |
| JP | 11-280579 | * | 10/1999 |

OTHER PUBLICATIONS

European Patent Office 163,629 Dec. 1985.*
European Patent Office 547,011 Jun. 1993.*

* cited by examiner

*Primary Examiner*—Frankie L. Stinson
(74) *Attorney, Agent, or Firm*—Pearne & Gordon LLP

(57) ABSTRACT

Dishwashing machine with a distribution valve (5) which is arranged on the delivery-side section of the washing liquor circulation pump and is provided with at least two outlets (51, 52, 53) connected via associated conduits (61, 62, 63) to rotating spray arms, as well as at least a shutter means (8). The shutter means (8) is not only adapted to be alternately displaced from a position in which it enables liquor to be delivered to at least a rotating spray arm to a position in which it enables a second rotating spray arm to be supplied with liquor, in accordance with a programmed stop time (D1) of the pump, but is also adapted to be displaced into a further position in which it enables liquor to be delivered to at least two rotating spray arms at the same time, in accordance with a second stop time (D2) of the same pump.

5 Claims, 3 Drawing Sheets

DISHWASHING MACHINE WITH LIQUOR DISTRIBUTION VALVE

This application claims the benefit of International Application Number PCT/EP00/04692, which was published in English on May 23, 2000.

DESCRIPTION

The present invention relates to an automatic dishwashing machine, i which the washing liquor is pumped to flow into a water-carrying circuit comprising a distribution valve arranged on the delivery-side section of the liquor circulation pump. In the context of this patent, the term washing liquor is used to indicate both the detergent-containing water solution, which is used to carry out the actual washing, ie. soil removal phases, and the sole water medium used in rinsing phases.

A dishwashing machine of the kind adapted to operate with its rotating spray arms being alternately supplied with liquor, and therefore with a reduced amount of washing liquor and a low energy usage altogether, is known from the European patent publication 237 994, whose owner is currently this same Applicant. Such a result is obtained with the use of a valve that comprises a shutter member and at least a first and a second outlet that are connected to respective conduits provided to supply corresponding rotating spray arms, which are in turn spaced vertically from each other. A calibrated offtake passage connects the delivery of the washing liquor circulation pump with the first outlet of the valve.

The shutter member of the valve:

a) moves by gravity into a stable position adjacent to the first outlet of the distribution valve;

b) is adapted to shut that same first outlet, in a first phase of operation of the pump, under the pushing force exerted by the washing liquor flowing into the second conduit, while however leaving said calibrated offtake passage clear and open;

c) is adapted to be displaced into an unstable position, which is adjacent to said second outlet, during a predetermined stop period of the pump, owing to the washing liquor flowing backwards along said first conduit d) is adapted to shut the second outlet of the distribution valve, during a second phase of operation of the pump, which substantially begins when the same first conduit is being emptied.

Thanks to such a kind of construction, the so equipped dishwashing machines have been able to be awarded an "A" rating in energy usage, ie. efficiency, in the label introduced in accordance with the appropriate European Union directives, with a corresponding significant success on the marketplace. On the other hand, their actual washing, ie. soil-removal performance, eg. in the case of particularly heavily soiled washload items, may not be so good as the performance generally ensured by conventional machines, ie. machines working with both rotating spray arms operating at the same time. It can in fact be readily appreciated that, for a same length or duration of the phases of the washing cycles, the actual length of the time during which any of the washload items in these machines is sprayed with washing liquor is just a fraction of the actual length of the time during which the washload items in conventional machines, m which both rotating spray arms operate at the same time, are sprayed.

It would on the contrary be desirable, and it is actually a first purpose of the present invention, to provide a dishwashing machine that is capable of being awarded an "A" rating on the above mentioned European Union label not only for energy efficiency merits, but also as far as its washing and rinsing performance capabilities are concerned This and further aims of the present invention are reached in a dishwashing machine which, while maintaining the features according to the afore cited European patent, additionally has the features that are recited in the appended claims.

Solely by way of non-limiting example a household-type dishwashing machine of the kind with two washload carrying racks and three rotating spray arms arranged above each other is described below with reference to the accompanying drawing of the sole parts having a direct connection with the present invention, in which.

Figure 1:
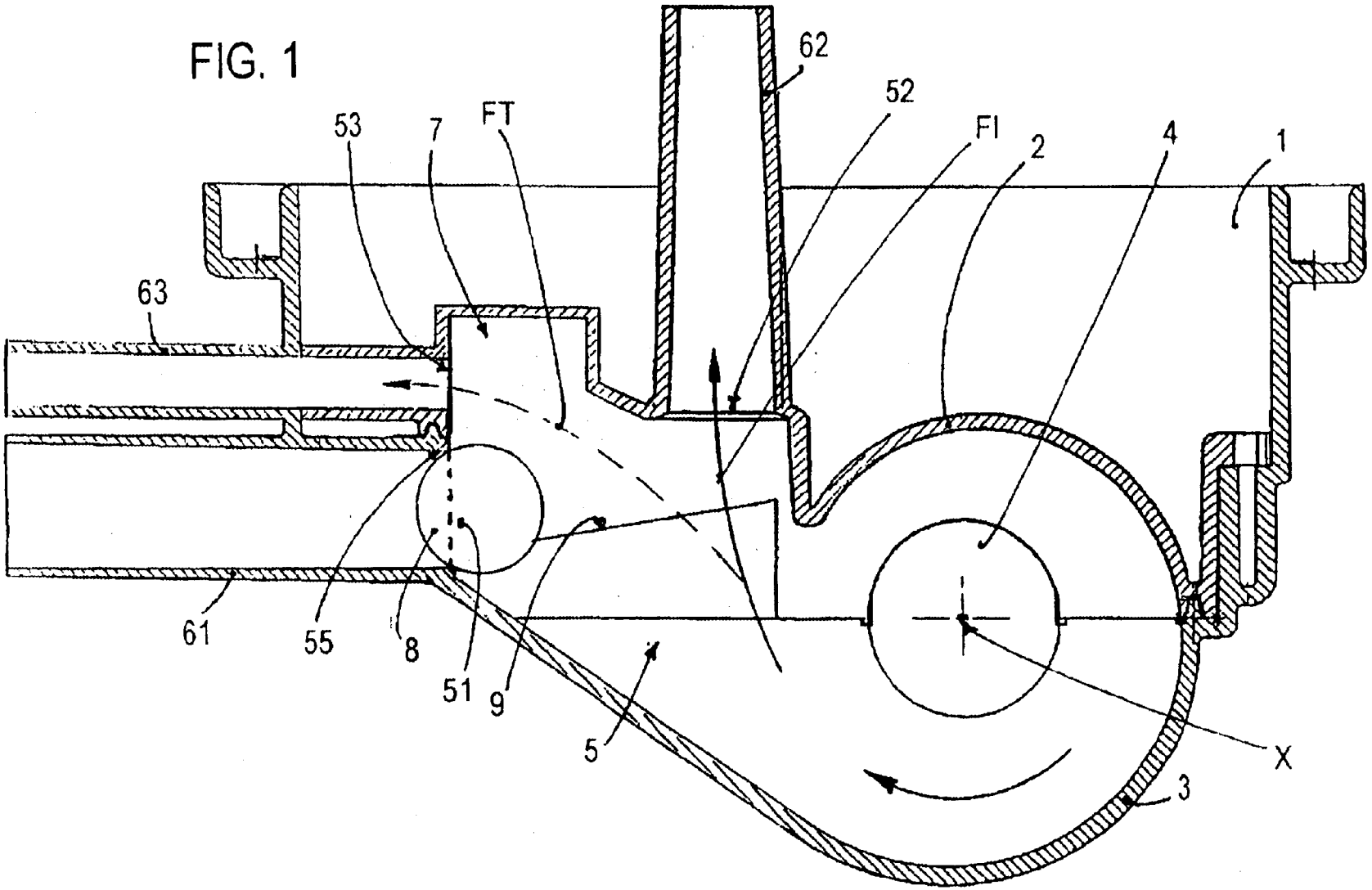
FIG. 1 is a view referring to both the machine in a non-operating state and the rotating spray arm associated to the lower rack in the operating position thereof.

The above listed Figures can be noticed to illustrate, according to a vertical section plane, the sump 1 of a dishwashing machine, which is made of injection-moulded plastic material and is joined to the two portions 2 and 3 of the electric circulation pump body, made in the same way as the sump, by means of well-known joining means (not shown). The impeller of said pump which is shown schematically in the Figures with a simple circle 4, and whose horizontal axis is indicated at X, is adapted to be operated intermittently, preferably also at a variable speed, by the programmed sequence control switch (not shown) of the machine. Integrally with said body of the pump a washing-liquor distribution valve 5 is furthermore provided, which comprises:

a first outlet 51 that leads to a first conduit 61 extending up to the rotating spray arm (not shown) associated to the washload carrying rack (not shown, either) that is arranged in the upper portion of the washing vessel of the machine;

a second outlet 52 which is advantageously moulded integrally with a second conduit 62 to supply the liquor to the rotating spray arm (not shown) associated to the washload carrying rack (not shown, either) which is arranged in the lower portion of the washing vessel of the machine;

a third outlet 53, which is arranged in an intermediate position between the other outlets 51 and 52 and leads to a third conduit 63 extending up to the rotating spray arm (not shown) which is situated immediately close to the top or ceiling of the washing vessel of the machine;

a sealed-bottom recess 7, arranged in the immediate proximity of said third outlet 53 at a slightly greater height as, but at a distance from the first and the second outlet 51, 52 of the valve 5;

a ball 8, made of a heavier material than the washing liquor, which forms the shutter member of the valve;

a surface 9 which is sloping downwards, in the direction that goes from the impeller 4 of the pump towards the first conduit 61, for the ball 8 to be able to roll thereupon.

The first outlet 51 of the distribution valve 5 is adapted to be shut by gravity by the ball 8, which in this way finds a stable position here, while the machine is not operating—see FIG. 1. The same first outlet 51, however features along its periphery a calibrated passage 55, which can for instance be constituted by a simple bevel, which directly connects the delivery section of the pump with the first conduit 61.

In a first phase of operation of the circulation pump, the ball 8 remains in this stable position, so that the washing liquor is forced to flow into said second conduit 62, as indicated by the arrow FI in FIG. 1, through the second outlet 52 of the valve 5 so as to cause the rotating spray arm to operate, which is associated to the lower washload carrying rack. If the duration of this phase is sufficiently long and/or the rotation speed of the circulation pump is sufficiently high, it is possible for the washload items to be sprayed also by the rotating spray arm arranged on top of the washing vessel of the machine. As a matter of fact, a flow of washing liquor occurs also through the third outlet 53 of the valve 5 and the corresponding third conduit 63, as indicated again by the arrow FT in FIG. 1. In the meantime, however, through the calibrated passage 55 provided on the first outlet 51 of the valve 5, a small portion of the flow of washing liquor is able to seep into the first conduit 61 until the latter is practically wholly filled up.

In response to an appropriate command imparted by the programme sequence control switch of the machine, the circulation pump stops operating at this point for a first pre-determined length of time D1, thereby causing the washing liquor to start flowing backwards along the conduits of the liquor carrying circuit of the machine, in particular along the first conduit 61. As a result, the ball 8 is in this way pushed towards the second outlet 52, thereby moving into an unstable position along the machined surface 9 in any intermediate point between the outlets 51 and 52.

Figure 2:
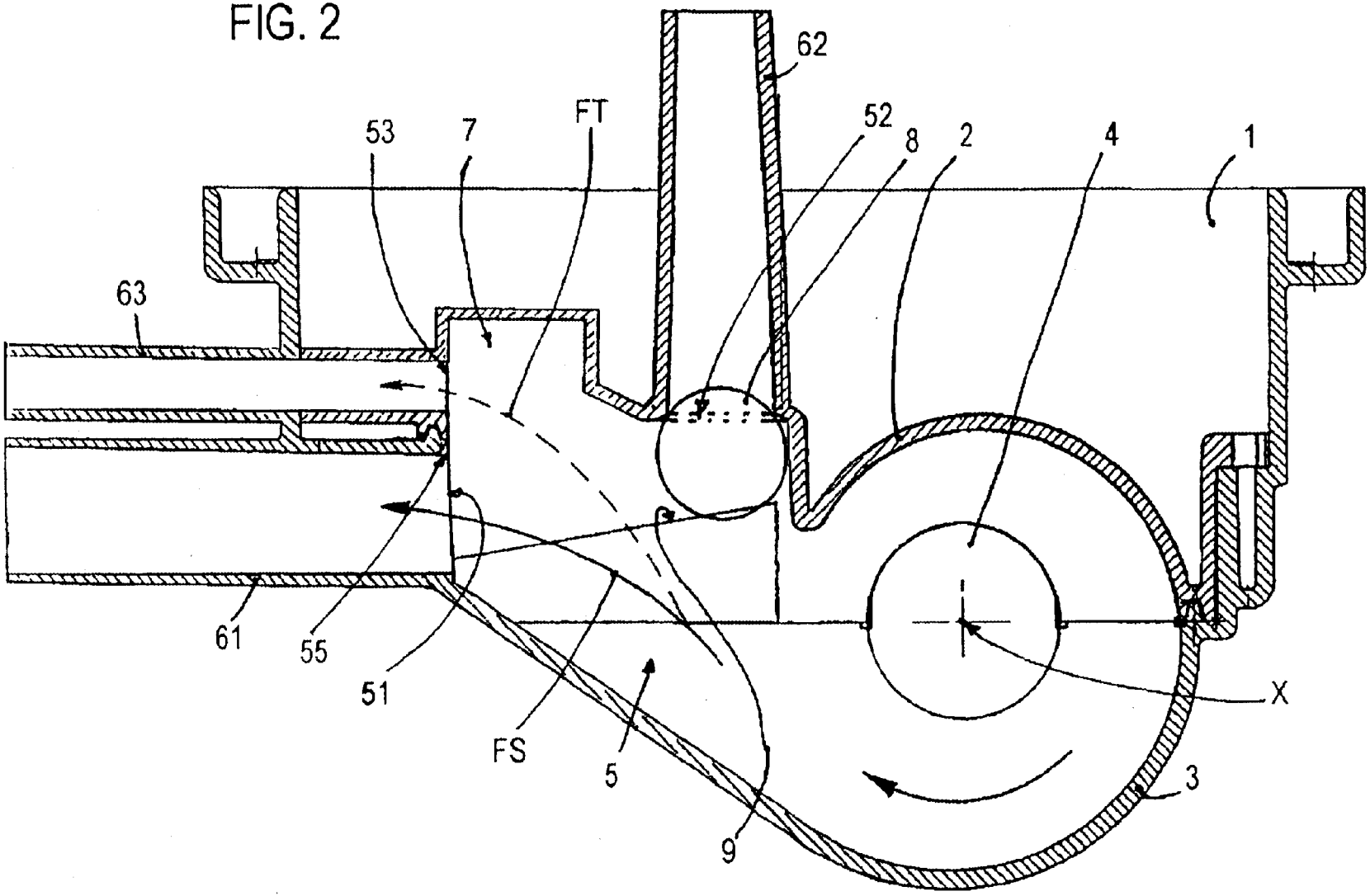
FIG. 2 is a view referring to the operating position of the rotating spray arm associated to the upper rack.

When said first conduit 61 is being so emptied, eg. just before it is emptied completely, the programme sequence control switch of the machine ensures a second phase of operation of the circulation pump, so as to enable the ball 8 to move into a position in which it closes the second outlet 52 of the valve 5. The ball 8 is then kept there by the flow of washing liquor through the first outlet 51 and the first conduit 61, as indicated by the arrow FS in FIG. 2, as well as possibly through the third outlet 53 and the third conduit 63, as indicated again by the arrow FT in FIG. 2. The operation is thereby obtained of the rotating spray arm associated to the upper washload-carrying rack and, possibly, also the rotating spray arm arranged on top of the washing vessel of the machine.

The operation of the machine that has been described hitherto is substantially the same as the one disclosed in the afore cited European patent 237 994, to which reference should therefore be made as far as all those construction and functional details of the machine are concerned, which have been omitted m this description of the present invention for reasons of greater simplicity.

Figure 3:
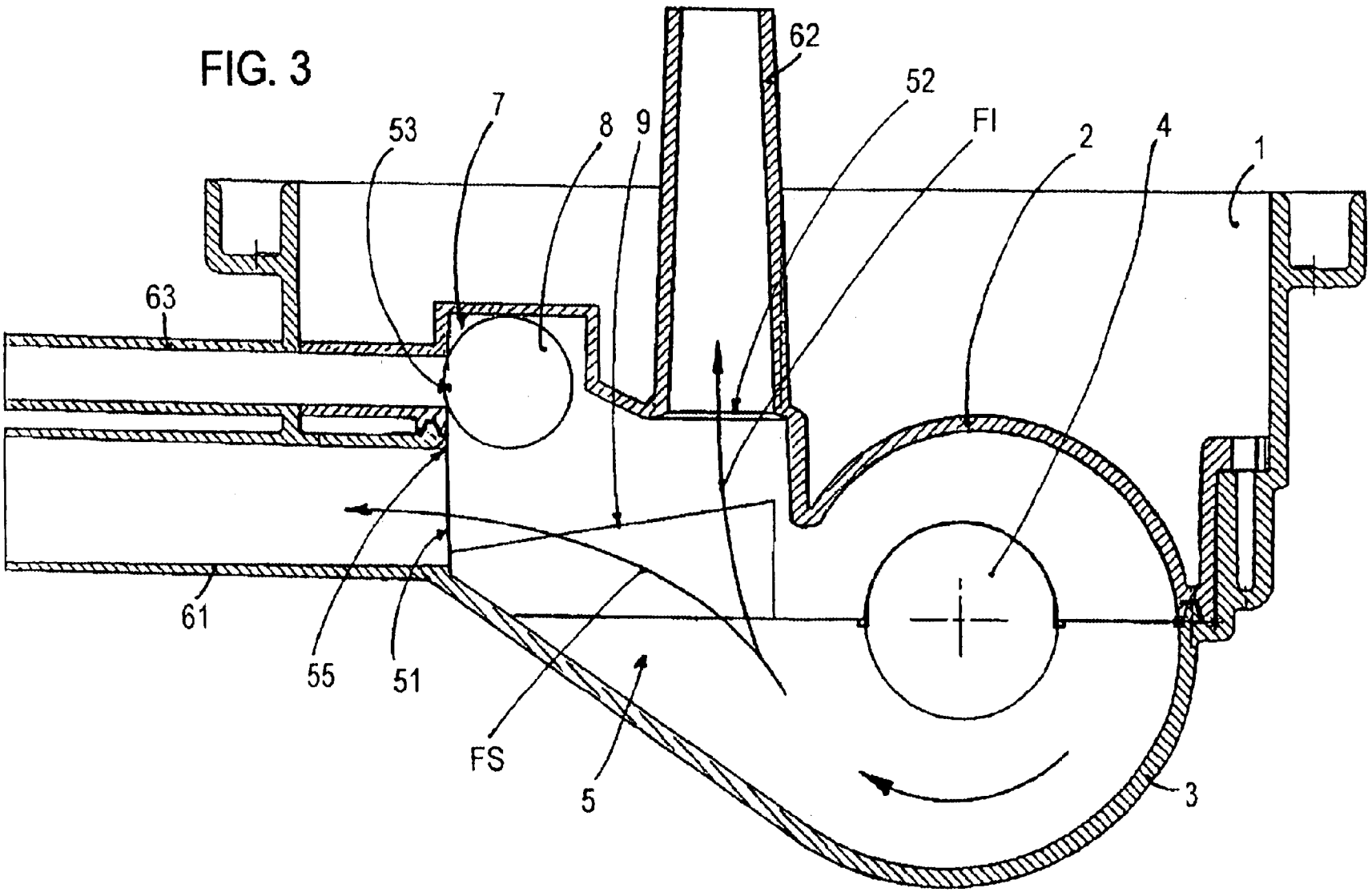
FIG. 3 is a view referring to the operating position of all three rotating spray arms at the same time.

A substantial feature of the present invention is on the contrary the additional possibility for the operation of the circulation pump of the machine to be stopped for a length of time having a pre-set duration D2, which is different from the previous one (preferably shorter than the previous one, since this would prove easier to obtain), so as to be able to cause the ball 8 to move into a second unstable position, which is actually provided in the sealed-bottom recess 7 at a distance from both the first and the second outlet 51, 52 of the valve 5—see FIG. 3. As a result, when the programme sequence control switch of the machine commands the circulation pump to start operating again, the washing liquor will be able to flow into both said first and said second conduits 61 and 62 and, therefore, reach both rotating spray arms associated to the washload carrying racks, as indicated again by the arrows FI, FS in FIG. 3. In other words, all the washload items arranged in the washing vessel of the machine are in this way able to be sprayed at the same time, thereby ensuring an improved washing and rinsing efficiency of the machine.

The advantages deriving from the present invention can be summarized as follows:

I) for a same duration, if the selected washing programme ensures stop periods of the circulation pump between the first and the second phase of this second length of time D2, instead of the first length of time D1 as provided for by the afore mentioned European patent, an overall performance improvement is obtained in the washing and/or rinsing effect of the washload items arranged on the two racks, since they are exposed to sprayed liquor for an actually longer period of time;

II) as an alternative thereto, the performance capability of the machine can be maintained unaltered, while reducing the overall duration of the washing programme correspondingly;

III) the modifications that have to be made in the construction of the dishwashmg machine to such a purpose are easily and quickly implemented at costs that are definitely low, since they are confined to the provision of the sealed-bottom recess 7 in the body of the valve 5 and/or the circulation pump.

Although the invention has been described here with reference to a currently preferred embodiment thereof, it will be readily appreciated that it can be implemented in a number of different embodiments as well, in particular with two rotating spray arms only, ie. with only two outlets 51, 52 of the valve.

What is claimed is:

1. Dishwashing machine, in which the washing liquor flows into a liquor-carrying circuit that comprises at least two rotating spray arms, a circulation pump, a liquor distribution valve (5) arranged on the delivery-side section of said pump and provided with at least two outlets (51, 52, 53), in which the first outlet (51) leads to a first conduit (61) extending up to a first rotating spray arm, whereas the second outlet (52) and any further outlet (53) that may be possibly provided lead to respective conduit (62, 63) extending up to other corresponding rotating spray arms, said valve (5) being her provided with at least a shutter member (8), which:

is adapted to keep, by the effect of gravity, a stable position in which it shuts said first outlet (51) when the machine is not operating and during a first phase of operation of the pump, but leaves a calibrated passage (55) open, which directly connects the delivery-side section of the pump with the first one (61) of said conduits;

is adapted to be displaced into a first unstable position, adjacent to a second outlet (52) of the distribution valve (5), during a stop period of the pump having a first pre-set duration (D1), owing to the action of the washing liquor flowing backward along the same first conduit (61);

is adapted to shut said second outlet (52) in a subsequent phase of operation of the pump which substantially starts before said first conduit (61) becoming completely empty, characterized in that the shutter member (8) is further adapted to be displaced into a second unstable position (7) following a stop period of the pump having a second pre-set duration (D2), which is different from said first duration (D1), so as to enable at least two rotating spray arms to operate at the same time.

2. Dishwashing machine according to claim 1, characterized in that said second pre-set duration (D2) of the stop period of the circulation pump is shorter than said first pre-set duration (D1).

3. Dishwashing machine according to claims 1 or 2, characterized in that said second unstable position (7) is spaced from both said first and said second outlets (51, 52).

4. Dishwashing machine according to claim 1, which comprises at least a third rotating spray arm adapted to be supplied by an associated outlet (53) of the distribution valve (5) and an associated conduit (63), characterized in that said second unstable position (7) is situated in the immediate proximity of said outlet (53) and at a slightly greater height.

5. Dishwashing machine according to any of the preceding claims, in which the shutter member (8) consists of a spherical body made of a corrosion-resistant material and having a greater specific gravity than the washing liquor, characterized in that, in order to provide said second unstable position (7), a seat in the form of a sealed-bottom recess is provided in the casing of the distribution valve (5) and/or the circulation pump.

* * * * *

UNITED STATES PATENT AND TRADEMARK OFFICE

CERTIFICATE OF CORRECTION

PATENT NO. : 6,705,330 B1
DATED : March 16, 2004
INVENTOR(S) : Ugo Favret

It is certified that error appears in the above-identified patent and that said Letters Patent is hereby corrected as shown below:

Title page,
Item [56], References Cited, U.S. PATENT DOCUMENTS, please delete
"4,741,353 A * 5/1988 Miloccco", and insert therefor
-- 4,741,353 A * 5/1988 Milocco --.

Column 1,
Line 6, please delete "May 23, 2000", and insert therefor -- January 18, 2001 --.
Line 64, please delete "m", and insert therefor -- in --.

Column 3,
Line 51, please delete "m", and insert therefor -- in --.

Column 4,
Line 22, please delete "dishwashmg", and insert therefor -- dishwashing --.
Line 45, please delete "her", and insert therefor -- further --.

Column 6,
Lines 4-5, please delete "any of the preceding claims", and insert therefor -- claim 1 --.

Signed and Sealed this

Fourteenth Day of September, 2004

JON W. DUDAS
*Director of the United States Patent and Trademark Office*